United States Patent [19]

Wetter

[11] Patent Number: 4,570,743

[45] Date of Patent: Feb. 18, 1986

[54] NOISE PROTECTION DEVICE FOR A WINDING UNIT

[75] Inventor: Kurt Wetter, Hagenbuch, Switzerland

[73] Assignee: Rieter Machine Works Limited, Winterthur, Switzerland

[21] Appl. No.: 649,222

[22] Filed: Sep. 10, 1984

[30] Foreign Application Priority Data

Sep. 14, 1983 [CH] Switzerland ..... 5001/83

[51] Int. Cl.[4] ..... B65H 54/20; G10K 11/00

[52] U.S. Cl. ..... 181/200; 181/205; 181/287; 242/35.5 R; 57/1 R

[58] Field of Search ..... 181/30, 200, 205, 284, 181/287, 295, 201; 242/18 DD, 35.5 R; 57/1 R

[56] References Cited

U.S. PATENT DOCUMENTS

| | | | |
|---|---|---|---|
| 2,277,983 | 3/1942 | Jacabs | 181/30 |
| 3,955,347 | 5/1976 | Shippers | 57/1 R |
| 4,074,725 | 2/1978 | Bader et al. | 181/200 X |
| 4,347,989 | 9/1982 | Pieper et al. | 242/35.5 R |

FOREIGN PATENT DOCUMENTS

| | | |
|---|---|---|
| 2346869 | 1/1975 | Fed. Rep. of Germany . |
| 3002849 | 7/1981 | Fed. Rep. of Germany . |
| 2143055 | 12/1977 | France . |
| 377250 | 4/1964 | Switzerland . |

*Primary Examiner*—Benjamin R. Fuller
*Attorney, Agent, or Firm*—Werner W. Kleeman

[57] ABSTRACT

In order to hold at a minimum the noise emission of the winding gear in a winding unit of a spinning machine for the processing of endless filaments, the winding unit is provided with a noise protection door which is pivotingly translatable from an initial or idle position at the side of the winding unit into an operating position in front of the winding unit. The noise protection door comprises a guide portion which is supported or guided by means of rolls and guide pins and a noise protection portion pivotally supported on the guide portion by means of pivot pins. The guide pins forming part of the guide portion and the guide pins forming part of the noise protection portion project into two guide grooves arranged in mirror-image fashion, one of which is provided in a floor plate and the other in a cover of the winding unit. Thus the guide portion is guided in a straight line and the noise protection portion is pivotally guided.

4 Claims, 6 Drawing Figures

NOISE PROTECTION DEVICE FOR A WINDING UNIT

BACKGROUND OF THE INVENTION

The present invention broadly relates to noise protection devices and, more specifically, to a new and improved noise protection device for a winding unit of a spinning machine for the processing of endless filaments.

Due to the currently prevalent high thread line or travel speeds, for instance of 6000 m/min. and more, during winding of endless filaments and the resulting mechanical noise, the machine manufacturer is obliged to reduce noise emission by an acoustic attenuation or noise protection device. A noise protection device is known from the German Patent Publication No. 3,002,849, published July 30, 1981 corresponding to the U.S. Pat. No. 4,347,989, granted Sept. 7, 1982 in which a movable noise protection wall can be shifted manually along the spinning machine from winding unit to winding unit in order to screen off the winding unit against noise emission during the start of winding.

The disadvantages of this noise protection device consist in that, on the one hand, it must be manually moved from winding unit to winding unit, and, on the other hand, the noise emission is thereby reduced only during threading up.

SUMMARY OF THE INVENTION

Therefore, with the foregoing in mind, it is a primary object of the present invention to provide a new and improved construction of a noise protection device which does not exhibit the aforementioned drawbacks and shortcomings of the prior art constructions.

Another and more specific object of the present invention aims at providing a new and improved construction of a noise protection device of the previously mentioned type which serves for reduction of noise emission during all operating phases.

Yet a further significant object of the present invention aims at providing a new and improved construction of a noise protection device of the character described which is relatively simple in construction and design, extremely economical to manufacture, highly reliable in operation, not readily subject to breakdown and malfunction and requires a minimum of maintenance and servicing.

Now in order to implement these and still further objects of the invention, which will become more readily apparent as the description proceeds, the noise protection device of the present invention is manifested by the features that such noise protection device comprises a noise protection door which is pivotingly translatable from an initial position at the side of the winding unit into an operating position in front of the winding unit.

The advantages attained by the invention consist in that the wind-up or winding unit remains open and without noise protection only during the new leading-in of the thread into the winding unit and during the removal of a full package. That is, during starting-up and operation of the wind-up unit the noise protection device is in its operative position and closes the unit off acoustically with respect to the exterior environment. The noise protection device is only opened when it is required to gain access to the interior of the wind-up unit.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
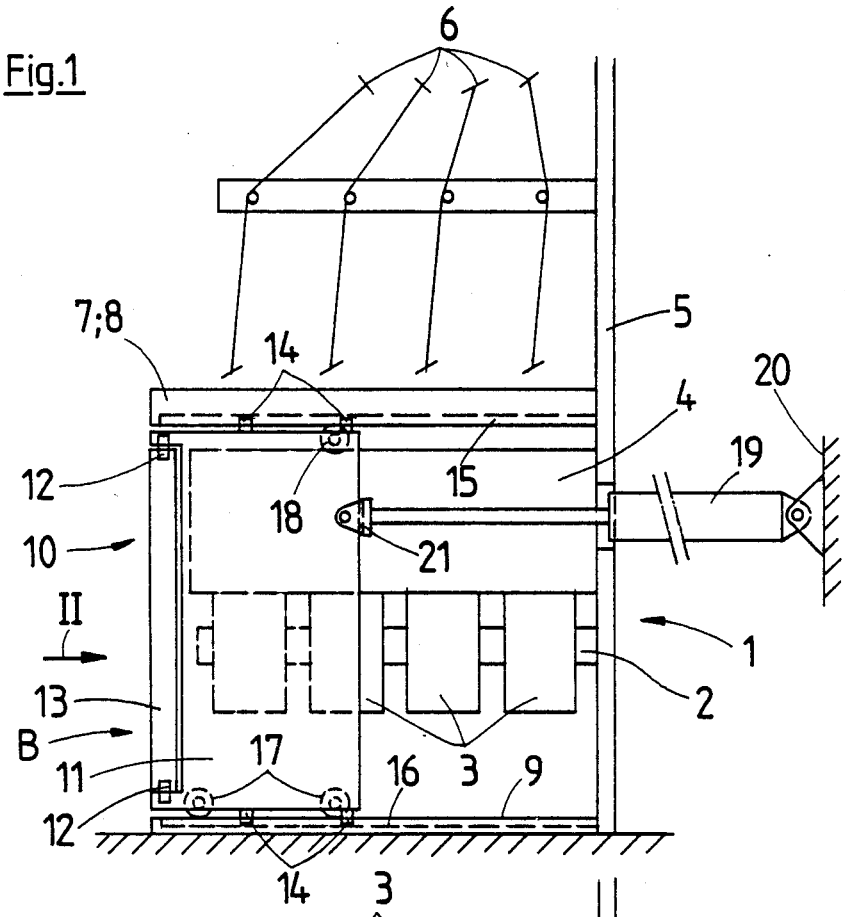
FIG. 1 shows a side view of a winding unit equipped with the noise protection device according to the invention as seen in the direction of the section line I—I in FIG. 2 and shown partially schematically.
Figure 2:
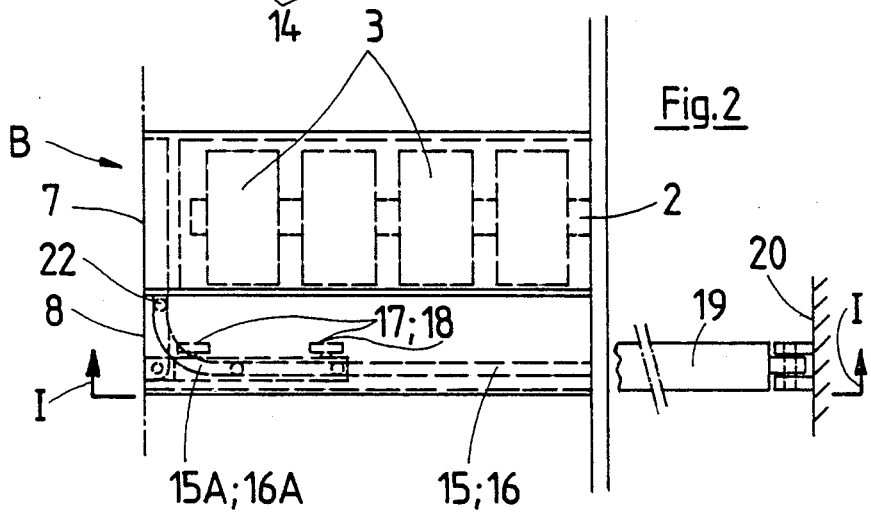
FIG. 2 shows a plan view of the winding unit and noise protection device of FIG. 1.
Figure 3:
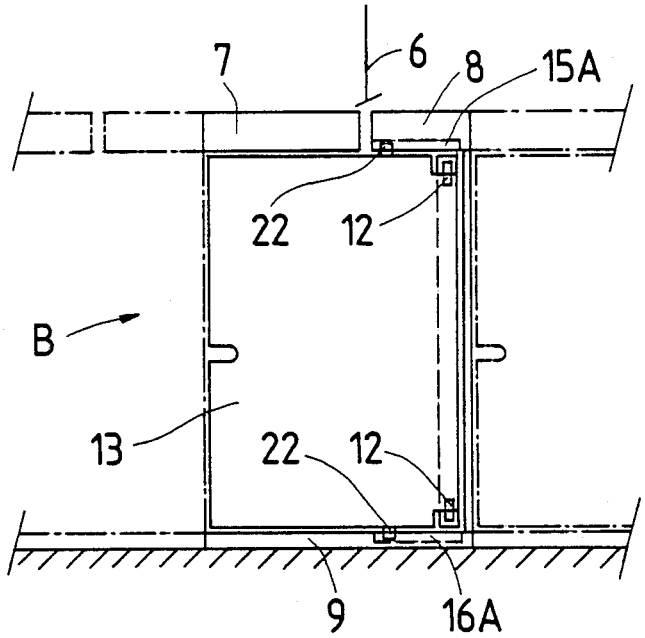
FIG. 3 shows a front view of the winding unit and noise protection device of FIG. 1, as seen in the direction of the arrow II in FIG. 1.

Describing now the drawings, it is to be understood that only enough of the construction of the device for reduction of noise emission or noise protection device has been shown as needed for those skilled in the art to readily understand the underlying principles and concepts of the present development, while simplifying the showing of the drawings. Turning now specifically to FIG. 1 of the drawings, a wind-up or winder unit 1 will be seen to comprise a chuck 2 with four packages 3, together with a drive assembly 4. The wind-up unit 1 is part of a spinning machine for the processing of endless filaments, the machine being indicated schematically with a wall 5. The threads of endless filaments processed in the spinning machine are represented schematically by the lines 6.

A wide cover 7 and a narrow cover 8, which are both fixedly secured to the wall 5, provide the upper cover of the wind-up or winder unit 1 which itself stands on a floor plate 9. There is provided a noise protection device embodying a noise protection door 10 which comprises a guide portion 11 and a noise protection portion 13 pivotally secured to the guide portion 11 by means of pivot pins 12 or equivalent structure.

The guide portion 11 is guided for movement on a side of the wind-up unit 1 laterally of and substantially parallel to the chuck 2 by means of guide pins 14 or the like which are guided, on the one hand, in an upper guide means, such as an upper guide groove 15, and on the other hand, in a lower guide means, such as a lower guide groove 16. The upper guide groove 15 is recessed or let into the narrow cover 8 and the lower guide groove 16 is recessed or let into the floor plate 9. Further, the guide portion 11 is supported on the floor plate 9 by means of two lower wheels 17 and is supported against the underside of the narrow cover 8 by an upper wheel 18. The upper wheel 18, as shown in FIG. 1, is so arranged that tilting of the guide portion 11 in an anticlockwise direction, as viewed in FIG. 1, is prevented.

For moving the guide portion 11, a fluid-operated, for instance a pneumatic cylinder 19 is connected, on the one hand, to a stationary base 20 of the spinning machine, and on the other hand, by way of the piston head or yoke 21, with the guide portion 11.

Figure 4A:
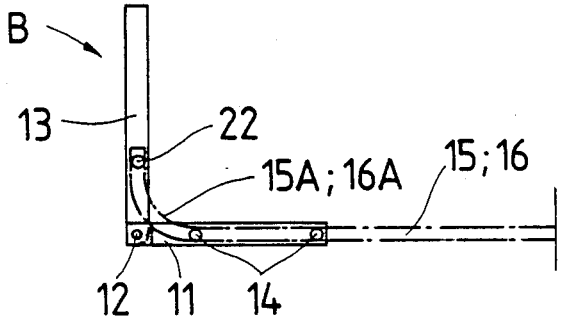
FIGS. 4*a* to 4*c* schematically show the sequence of movements of the noise protection device according to the invention in plan view.
Figure 4B:
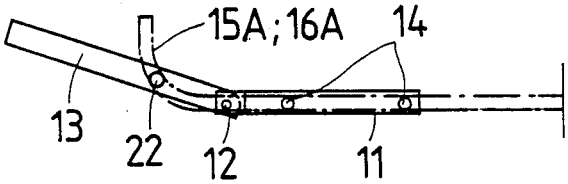
Figure 4C:
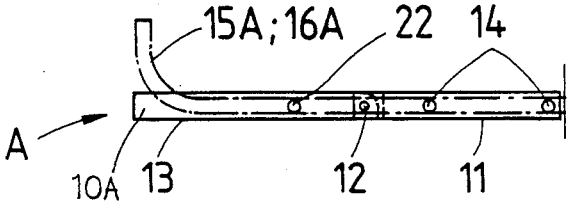

Furthermore, the guide grooves 15 and 16 each have, as shown in FIGS. 2 and 4*a* to 4*c*, a curved portion or bend 15A and 16A respectively, in each of which a guide pin 22, forming part of the noise protection portion 13, is guided so that during a movement of the guide portion 11 in the direction of the pneumatic cylinder 19 the noise protection portion 13, as illustrated in FIGS. 4*a* to 4*c*, is forced to swing or shift from the operative position B at the front or front side of the wind-up unit 1 illustrated in FIGS. 1 to 3 and 4*a* into the initial or idle position A at the side of the wind-up unit 1 illustrated in FIG. 4*c*. In this position A, the noise protection portion 13 is aligned with the guide portion 11 and is drawn thereby so far in the direction of the pneumatic cylinder 19 that the noise protection portion 13 no longer projects into the room or space, i.e. the free end 10A of the noise protection door 10, as shown in FIG. 4*c*, is substantially flush with the front or front side of the wind-up unit 1.

The use of the noise protection device according to the invention is not limited to any particular type of winding device.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A noise protection device for a winding unit of a spinning machine for processing of endless filaments, comprising:

a chuck arranged in said winding unit and holding a predetermined number of packages during a winding operation;

said winding unit defining a predetermined side laterally of and substantially parallel to said chuck;

said winding unit further defining a front side;

a noise protection door selectively assuming an initial position on said predetermined side laterally of the chuck;

said noise protection door further selectively assuming an operative position on the front side of said winding unit; and means for pivotingly displacing said noise protection door between said initial position laterally of said chuck and said operative position on said front side of said winding unit.

2. A noise protection device for a winding unit of a spinning machine for processing of endless filaments, comprising:

a noise protection door having an initial position at a side of the winding unit and an operating position in front of the winding unit;

means for pivotingly translating said noise protection door from said initial position into said operating position;

said noise protection door comprising a guide portion and a noise protection portion;

said guide portion being translatable to said side of the winding unit;

said pivotingly translating means including means for pivotally mounting said noise protection portion at said guide portion; and said noise protection portion being pivotingly translatable in front of the winding unit.

3. A noise protection device for a winding unit of a spinning machine for processing of endless filaments, comprising:

a noise protection door having an initial position at a side of the winding unit and an operating position in front of the winding unit;

means for pivotingly translating said noise protection door from said initial position into said operating position;

a cover and a floor plate;

said noise protection door comprises guide pins;

guide grooves provided in said cover and in said floor plate and receiving said guide pins;

said noise protection door having a predetermined movement direction; and said movement direction of the noise protection door being controlled by means of said guide grooves into which project said guide pins of said noise protection door.

4. The noise protection device as defined in claim 1, wherein:

said noise protection door having a free end remaining in a substantially flush position with respect to the front side of the winding unit when said noise protection door assumes said initial position.

* * * * *